US006851856B2

(12) United States Patent
Yamada

(10) Patent No.: US 6,851,856 B2
(45) Date of Patent: Feb. 8, 2005

(54) BAG HAVING DEGAS STRUCTURE AND METHOD FOR PRODUCING THE SAME

(75) Inventor: Hiroyuki Yamada, Niigata (JP)

(73) Assignee: Emupack Co., Ltd., Isikawa (JP)

( * ) Notice: Subject to any disclaimer, the term of this patent is extended or adjusted under 35 U.S.C. 154(b) by 0 days.

(21) Appl. No.: 10/194,048

(22) Filed: Jul. 15, 2002

(65) Prior Publication Data

US 2003/0016888 A1 Jan. 23, 2003

(30) Foreign Application Priority Data

Jul. 19, 2001 (JP) ..... 2001-219979
Mar. 15, 2002 (JP) ..... 2002-072506

(51) Int. Cl.[7] ..... B65D 33/01
(52) U.S. Cl. ..... 383/103
(58) Field of Search ..... 383/100, 101, 383/102, 103

(56) References Cited

U.S. PATENT DOCUMENTS 3,528,600 A 9/1970 White
4,491,959 A * 1/1985 Loefberg ..... 383/103
4,573,203 A * 2/1986 Peppiatt ..... 383/29

FOREIGN PATENT DOCUMENTS

| | | | | |
|---|---|---|---|---|
| DE | 18 68 662 U | | 3/1963 | |
| DE | 2 053 097 | | 5/1972 | |
| EP | 0 243 750 A2 | | 11/1987 | |
| GB | 1152463 A | * | 5/1969 | ..... 383/103 |
| GB | 1162013 A | * | 8/1969 | ..... 383/103 |
| JP | 405338657 A | * | 12/1993 | ..... 383/100 |
| JP | 10-324350 A | | 12/1998 | |

* cited by examiner

*Primary Examiner*—Jes F. Pascua
(74) *Attorney, Agent, or Firm*—Sughrue Mion, PLLC

(57) ABSTRACT

To provide a bag having a novel degas structure that is highly valuable as a commercial product with a high sales point and a method for producing the bag. In the bag body having the degas structure for receiving granules 1 such as grains or manure, a fold-back overlap portion 3 that is folded back and kept under an overlap condition is provided at a predetermined position of the bag body 2, a through-hole is provided in overlap portions 5 forming the fold-back overlap portion 3, and the through-hole is used as a degas hole 4 for discharging air held in an interior of the bag body 2.

7 Claims, 7 Drawing Sheets

BAG HAVING DEGAS STRUCTURE AND METHOD FOR PRODUCING THE SAME

BACKGROUND OF THE INVENTION

1. Field of the Invention

The present invention relates to a bag having a degas structure and a method for producing the bag.

2. Description of the Related Art

A bag made of synthetic resin has been conventionally proposed for receiving granules or grains such as cereals or manure or fertilizer. The bag is of a type which is obtained by a laminate method of overlapping a plurality of pieces of resin film together and melt-bonding (sealing) their ends with each other or of a type which is obtained by an inflation method of blowing synthetic resin from an annular slit formed in a mold together with air.

However, when granules are filled in the bag made of synthetic resin, if the air introduced into the bag together with the granules is not removed but sealed, the bag is kept under the inflated condition due to the air to cause to collapse of the load alignment or to reduce the receiving space.

Accordingly, there are various conventional approaches to remove the unnecessary air from the bag by providing holes (punched holes) in the bag and utilizing the holes as degas holes for removing the air from the bag or by providing a portion, which is not subjected to the thermal bond, to a thermal bond portion upon molding the bag and utilizing the non-thermally bonded portion as degas holes.

However, when the granules are filled into the bag actually, the degas holes provided in the bag made of synthetic resin are deformed (expanded) due to the filling pressure of the granules to cause to leak the content or the degas holes are clogged by the pseudo-bond by the blocking of the film, resulting in non-function of the degas holes. As a result, it is impossible to well discharge the unnecessary air. Furthermore, in view of the structure, there is a problem that water, dust or bugs are likely to enter into the interior of the bag from the outside. Thus, the conventional bag suffers from various disadvantages.

SUMMARY OF THE INVENTION

In order to overcome the above-described disadvantages, an object of the present invention is to provide a bag having a novel degas structure that is highly valuable as a commercial product with a high sales point and a method for producing the bag.

The features of the present invention will now be described.

According to the present invention, there is provided a bag body having a degas structure for receiving granules such as grains or manure, characterized in that a fold-back overlap portion that is folded back and kept under an overlap condition is provided at a predetermined position of the bag body, a through-hole is provided in overlap portions forming the fold-back overlap portion, and the through-hole is used as a degas hole for discharging air held in an interior of the bag body.

In the bag body having a degas structure according to the first aspect, according to a second aspect, a fold-back overlap portion that is folded back and kept under an overlap condition is provided at a predetermined position of the bag body, a through-hole is provided in an overlap portion not exposed outside out of the overlap portions forming the fold-back overlap portion so that the through-hole is covered by other overlap portions, and the through-hole is used as a degas hole for discharging air held in an interior of the bag body.

In the bag body having a degas structure according to the first or second aspect, according to a third aspect, the fold-back overlap portion fold back at a predetermined position of the bag body as the fold-back overlap portion and composed of at least three overlap portions is provided and the degas hole is formed in the overlap portions forming the fold-back overlap portion.

In the bag body having a degas structure according to any one of the first, second and third aspect, according to a fourth aspect, the bag body made of synthetic resin is adopted as the bag body, the fold-back overlap portion provided in the bag body is overlapped and fixed, non-thermally bonded portions that are not thermally bonded are provided in the folded-back overlap portion, and the non-thermally bonded portions are provided as degas paths in communication with the degas hole.

In the bag body having a degas structure according to the fourth aspect, according to a fifth aspect, a vicinity position, which is a predetermined position of the bag body, of the thermal bonded portion relating to the folded-back overlap portion is thermally bonded.

In the bag body having a degas structure according to any one of the first to fifth aspects, according to the sixth aspect, the fold-back overlap portion is provided in an edge portion of the bag body.

According to the present invention, there is provided a bag body having a degas structure for receiving granules such as grains or manure, characterized in that a fold-back overlap portion that is folded back in V-shape on the inside and composed of four layers of overlap portions are provided in a predetermined position of a bag body, a through-hole is provided in at least one of the overlap portions of the inside two layers out of the overlap portions forming the folded back overlap portion, the through-hole is provided as a degas hole for discharging air, the fold-back overlap portion is thermally bonded, overlapped and fixed, non-thermally bonded portions that are not thermally bonded are provided in the folded-back overlap portion, and the non-thermally bonded portions are provided as degas paths in communication with the degas hole.

According to the present invention there is provided a method for producing a bag body having a degas structure for receiving granules such as grains or manure in which a fold-back overlap portion that is folded back and kept under an overlap condition is provided at a predetermined position of the bag body, a through-hole is provided in overlap portions forming the fold-back overlap portion, and the through-hole is used as a degas hole for discharging air held in an interior of the bag body.

According to the present invention, for example, when the grains such as grains or manure are filled in the interior of the bag body, the air introduced into the bag body together with the grains is discharged from the degas holes in accordance with the filling of the grains.

According to the present invention, the degas holes are provided in the overlap portions forming the folded-back overlap portion provided in the bag body. The grains are filled in the interior of the bag body so that the space in the vicinity of the degas holes is expanded to exhibit the function to serve as the good degas hole always. The grains filled in the interior of the bag body could not reach the degas holes so far as the grains do not pass through the gap between the overlap portions forming the folded-back overlap portion. Accordingly, for example, even if the pressure is applied in the interior of the bag body, the grains are hardly leaked from the degas holes.

Accordingly, since the degas holes provided in the bag body have structures in which the air is well discharged by the filling of the grains to the bag body, there is no fear that the unnecessary air is left in the bag body after filling the grains. Accordingly, there is no problem that the load alignment is collapsed during receipt or the receiving space is reduced. In addition, since the portion provided with the degas holes is of the fold-back overlap structure, the grains are hardly leaked from the interior of the bag body (degas holes), and the water, dust or bugs are hardly introduced into the interior from the outside of the bag body. These problems are well overcome.

As described above, according to the present invention, a novel resultant effect is exhibited, which is very high in commercial value.

DESCRIPTION OF THE PREFERRED EMBODIMENTS

Figure 1:
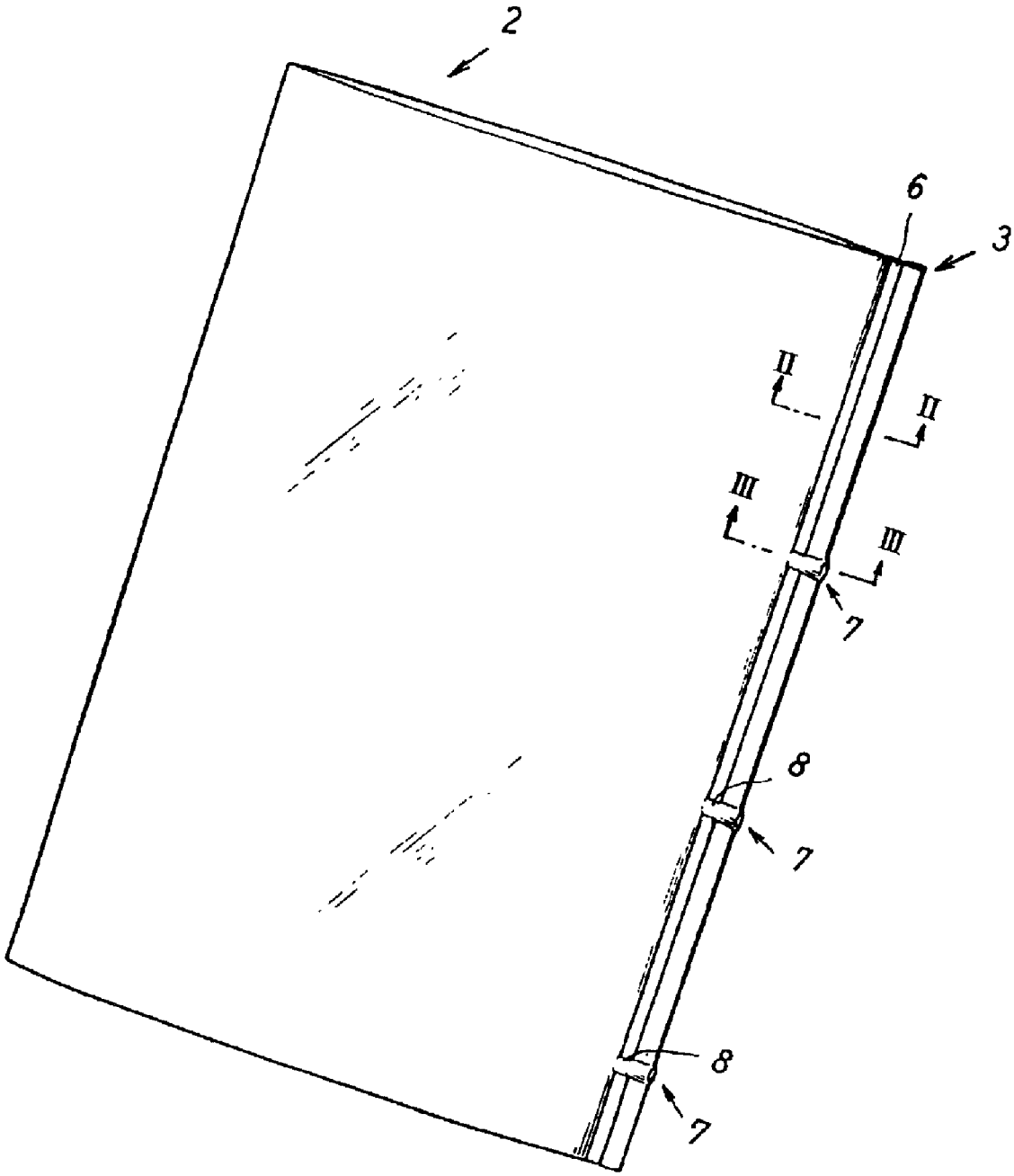
FIG. 1 is a perspective view showing a first embodiment.
Figure 2:
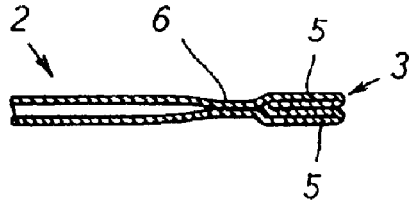
FIG. 2 is a cross-sectional view taken along the line II—II of FIG. 1.
Figure 3:
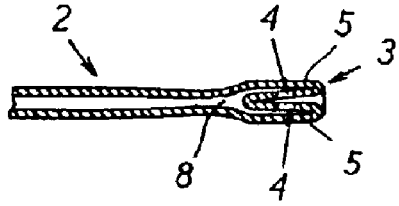
FIG. 3 is a cross-sectional view taken along the line III—III of FIG. 1.
Figure 4:
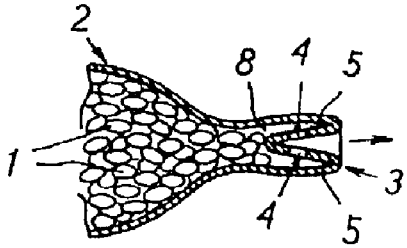
FIG. 4 is an illustration showing a cross-section of a primary part in accordance with the first embodiment.
Figure 5:
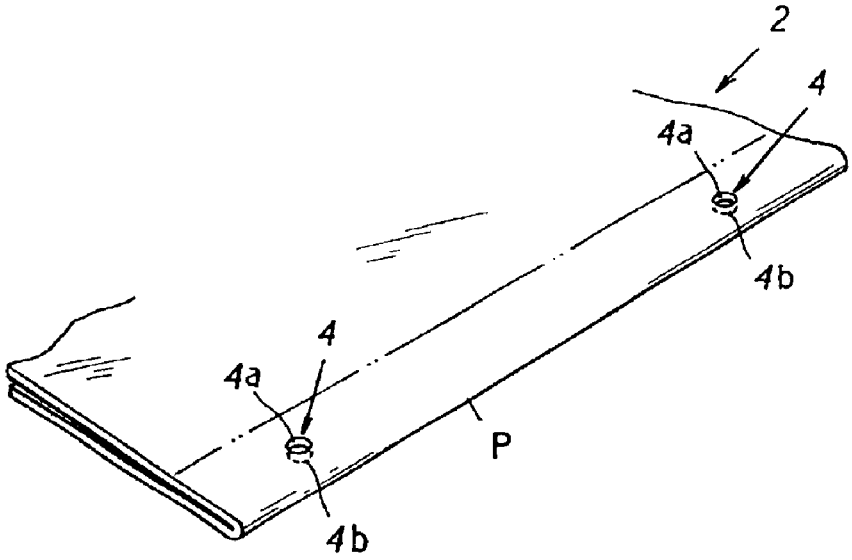
FIG. 5 is an illustration showing a manufacturing step for a degas structure in accordance with the first embodiment.
Figure 6:
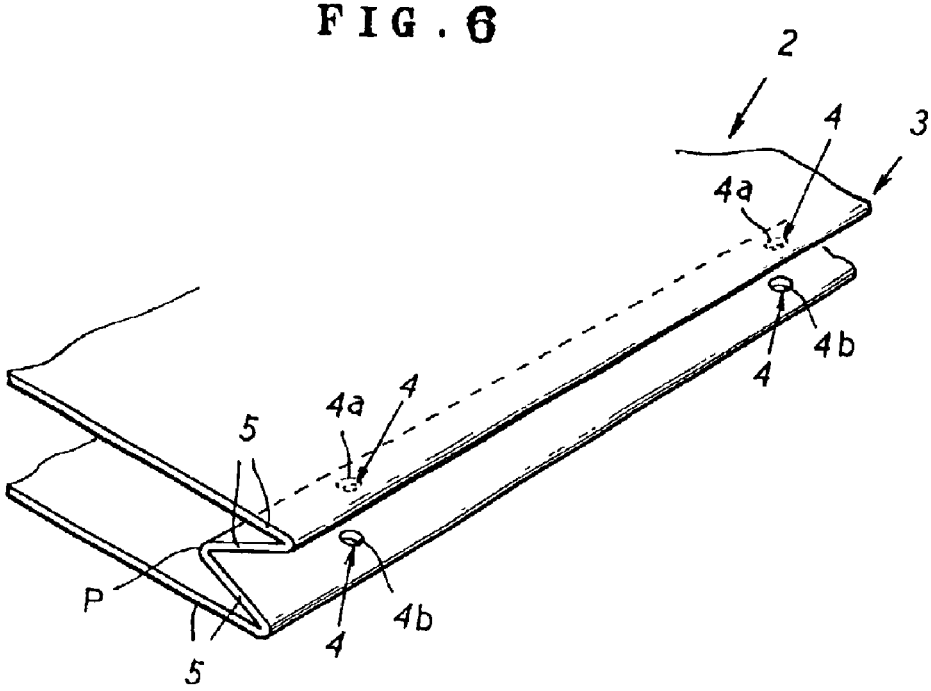
FIG. 6 is an illustration showing a manufacturing step for the degas structure in accordance with the first embodiment.
Figure 7:
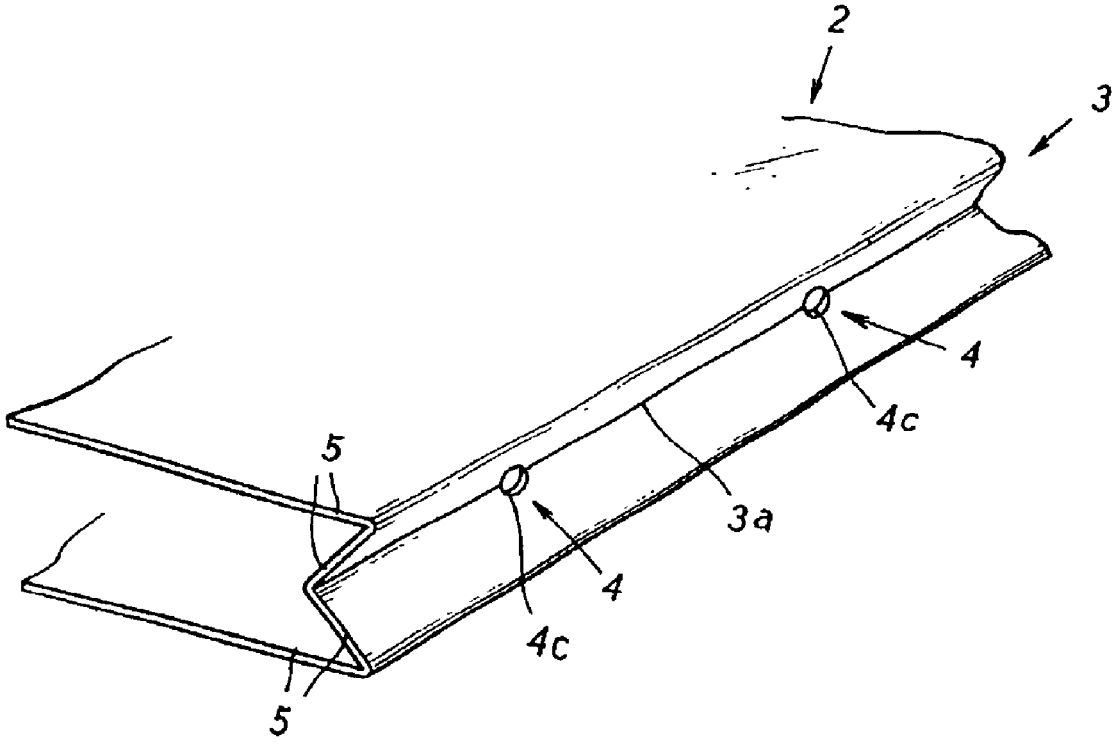
FIG. 7 is an illustration of a primary part in accordance with a second embodiment.

FIGS. 1 to 6 show a first embodiment of the present invention, FIG. 7 shows a second embodiment and FIGS. 8 to 12 show a third embodiment, which will now be described.

The first embodiment will now be described.

In the first embodiment, a bag is used for receiving granules 1 such as grains, beans, seeds, manure and fodder. Degas structures 7 are provided at predetermined positions of this bag 2.

Each part of the structure according to this embodiment will now be described in detail.

The bag 2 is obtained through an inflation method. More specifically, suitable synthetic resin (PE, PP, LLDPE, EVA, PVA and PVC in case of a non-expansion method, PE, PP, NY and PS in case of an expansion method) is blown together with air from an annular slit provided in a mold to be formed into a sleeve-like shape. The sleeve-like resin molded member is thermally bonded at predetermined positions in a width direction and at the same time, a portion in the vicinity of the thermally bonded portion is cut and formed into a bag-shape. (The bag 2 obtained by this inflation method is of a seamless type in its longitudinal direction.)

Incidentally, there is a laminate method as the method for producing the bag body 2 in addition to the inflation method as described above. It is possible to suitably adopt any suitable method if the feature of this embodiment is met.

Also, the three degas structures 7 are provided on one side (edge) of the bag body 2. Incidentally, the number of the degas structures 7 and the position where the degas structures 7 are to be formed may be selected suitably. (For example, the degas structures 7 may be provided in the middle of the bag body 2 in the longitudinal direction.)

The method of producing the degas structures 7 will now be described.

First of all, a pair of through-holes 4*a* and 4*b* (see FIG. 5) having a predetermined diameter (that is smaller than a diameter of the granules) are formed at opposite positions on the top and back surfaces of a side portion (edge portion) of the bag body 2. Subsequently, the center position P between the pair of through-holes 4*a* and 4*b* are folded back inside so that a folded-back overlap portion 3 (see FIG. 6) composed of four layer overlap portions 5 and formed into a V-shape (crest-shape) in cross-section and in a strip-shape is formed on one side of the bag body 2. Subsequently, the thermal bond is effected to a portion other than the four layer folded-back overlap portions 3 which are the portions where the through-holes 4*a* and 4*b* are provided. Incidentally, it is possible to suitably modify this embodiment, if the feature thereof is met, so that the folded-back overlap portion 3 may be folded into, for example, Z-shaped in cross section to form a three-layer overlap portion 5 or a plurality of folded-back portions 3 may be formed in parallel with each other.

The non-melt bonded portions in the folded-back overlap portion 3 are used as the degas paths 8 in communication with the interior of the bag body 2. The through-holes 4*a* and 4*b* provided in the two layers of the overlap portions 5 inside and not exposed to the outside out of the overlap portions 5 forming the folded-back overlap portion 3 serve as degas holes 4 for discharging the air passing through the degas paths 8. Then, each degas hole 4 is covered by the other overlap portion 5 (the overlap portion 5 exposed outside of the bag body 2). Incidentally, the degas holes 4 are formed in the two layers of the overlap portions 5 inside out of the overlap portions 5 forming the folded-back overlap portion 3 according to this embodiment. However, it is possible to form the degas hole only on one side. Thus, if the feature of the embodiment is met, it is possible to suitably select the number or the size (diameter) of the degas holes.

Also, according to this embodiment, the vicinity portion 6 extending along the thermal bond portion relating to the folded-back overlap portion 3 and located at a predetermined position of the bag body 2 is also thermally bonded in a strip-shape.

The reason for this is that in the case where the portion to be thermally bonded is only the folded-back overlap portion 3 composed of the four layer overlap portions 5, when the granules 1 are filled into the bag body 2, in particularly, if the thermal bond of the inside two layer overlap portions 5 is insufficient, there is a fear that the thermal bond could not stand the filling pressure of the granules 1 to be broken down. In view of this, according to this embodiment, the thermal bond is effected not only to the folded-back overlap portion 3 but also to the two layer portion 6 that is close to the folded-back overlap portion 3 in the strip-shape to thereby provide the sufficient strength that may stand the filling pressure of the granules 1 without fail.

Furthermore, in the case here the four layer portion and the two layer portion which are different in thickness are to be thermally bonded, two steps of thermal bonding work are needed due to the difference in thermal bonding temperature. However, for example, upon the molding (inflation molding) of the bag body 2, the slit portion corresponding to the folded-back overlap portion 3 of the bag body 2 is narrowed so that one side portion of the bag body 2 may be molded to be thin. Accordingly, even if this thin one side portion is folded back to form four layers, if this portion has substantially the same thickness as that of the two layer portion that is in the vicinity of the folded-back overlap portion 3, it is sufficient to effect the one step of thermal bonding work.

With such an arrangement according to this embodiment, when the granules 1 such as grains or manure is filled in the back body 2, the air introduced into the bag body 2 together with the granules 1 are removed from the degas holes 4 in accordance with the filling of the granules 1.

In this case, in this embodiment, the degas holes 4 are formed in the fold-back overlap portion 3 composed of the four layer overlap portions 5 and the degas paths 8 are expanded by filling the granules 1 into the bag body 2. Accordingly, the degas holes 4 exhibits the function to serve as the degas holes always (see FIG. 4). Then, the granules 1 filled within the bag body 2 could not reach the degas holes 4 so far as the granules do not pass through the overlap portions 5 forming the folded-back overlap portion 3. Accordingly, for example, even if the pressure is applied to the bag body 2, the granules 1 hardly leaks from the degas holes 4.

Accordingly, in accordance with this embodiment, since the degas holes 4 provided in the bag body 2 constitute the structure that the air may be discharged without fail, there is no fear that an unnecessary amount of the air is left in the bag body 2 after the granules 1 are filled. Accordingly, there is no problem that the collapse of the loads in reception occurs or the receiving space is reduced. In addition, since the portion where the degas holes 4 are provided are folded back, the granules 1 within the bag body 2 are scarcely leaked from the degas holes 4. The water, dust or bugs hardly would enter from the outside of the bag body 2. These problems are positively solved.

Also, in this embodiment, since the degas holes 4 are formed in the overlap portions 5 that are not exposed to the outside out of the overlap portions 5 forming the fold-back overlap portion 3, and the degas holes 4 are covered by the other overlap portions 5, it is possible to positively prevent the granules 1 from leaking from the degas holes 4 and to prevent the water, dust or bugs from entering the interior of the bag body 2 from the outside.

Namely, in the case where it is assumed that the granules 1 filled in the bag body 2 are leaked from the degas holes 4 according to this embodiment, the granules 1 have passed forcibly through such a gap between the overlap portions 5 through which the air may narrowly pass and thereafter have to expand the degas holes 4. This is actually impossible so far as such a condition that the extra pressure is applied to the interior of the bag body 2 is met. Accordingly, of course, the degas holes 4 of the degas structures 7 according to this embodiment exhibit sufficiently the degas function to prevent the granules 1, filled in the interior of the bag body 2, from leaking and prevent the water, dust or bugs from entering the interior from the outside of the structures.

Also, in this embodiment, since the degas structures 7 for removing the unnecessary air from the interior of the bag body 2 are provided on the side portion (edge portion) of the bag body 2, the bag may be used in a rice filling machine for performing automatically such a full work that the sleeve-like member made of synthetic resin produced according to, for example, the foregoing method is thermally bonded in a width direction and cut to form the bag body 2 and the rice is filled from the upper opening portion 2*a* of the bag body 2 and sealed.

Also, in this embodiment, the bag body 2 made of synthetic resin is used as the bag body 2, the folded-back overlap portion 3 provided in the bag body 2 is overlapped and fixed by thermal bonding, the non-thermally bonded portions that are not thermally bonded are provided in the folded-back overlap portion 3 and the non-thermally bonded portions are formed into the degas paths 8 in communication with the degas holes 4. Accordingly, the vent paths from the bag body 2 to the degas holes 4 are kept to thereby obtain the structure for performing the smooth degas with ease and without fail.

The second embodiment will now be described.

The second embodiment is of a type in which degas holes 4 are provided in a trough portion 3*a* of the overlap portion 3 as shown in FIG. 7.

More specifically, upon forming the bag body 2 (after blowing out from the mold during the inflation molding), the folded-back overlap portion 3 having a V-shape in cross section is formed in advance, and through-holes 4*c* are formed at a predetermined interval as the degas holes 4 in the trough portion 3*a* of the folded-back overlap portion 3. Thereafter, in the same manner as in the first embodiment, the thermal bond is effected to a portion other than portions that are the folded-back overlap portion 3 composed of the four layer overlap portions 5 and where the degas holes 4 (through-holes 4*c*) are provided.

The other structure is the same as that of the first embodiment.

The third embodiment will now be described.

In the third embodiment, the fold-back overlap portion 3 that is folded back and kept in the overlap condition is provided at a predetermined position of the bag body 2, through-holes are provided in the overlap portions 5, exposed outside, out of the overlap portions 5 forming the fold-back overlap portion 3, and these through-holes are used as degas holes 4 for discharging the air from the interior of the bag body 2.

Figure 8:
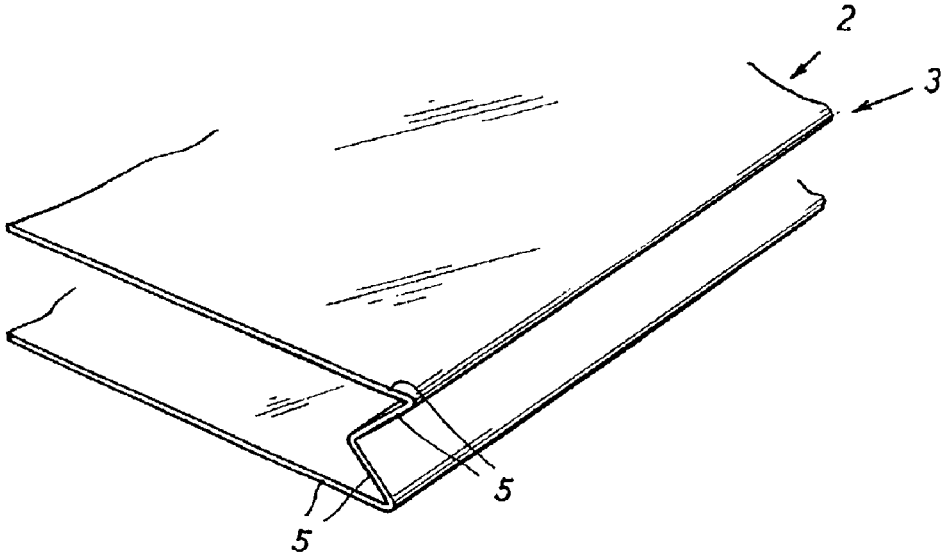
FIG. 8 is an illustration showing a manufacturing step for a degas structure in accordance with a third embodiment.
Figure 9:
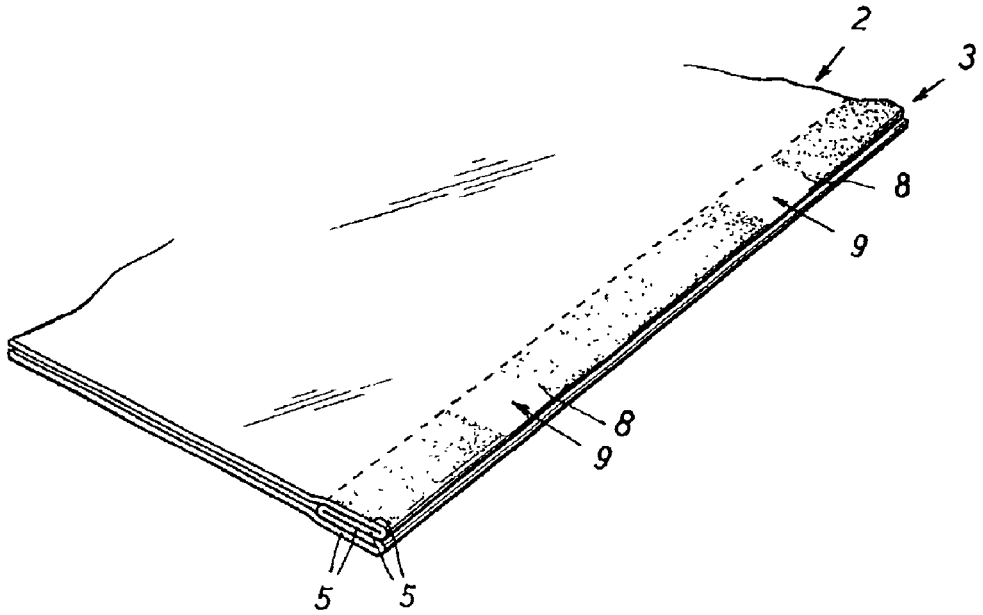
FIG. 9 is an illustration showing a manufacturing step for the degas structure in accordance with the third embodiment.
Figure 10:
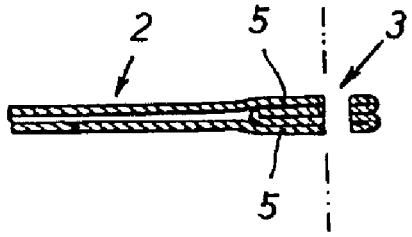
FIG. 10 is an illustration showing a manufacturing step for the degas structure in accordance with the third embodiment.
Figure 11:
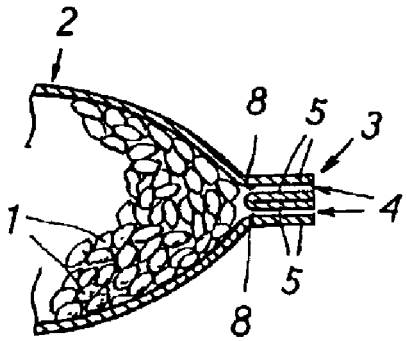
FIG. 11 is an illustration of a cross-section showing a primary part according to the third embodiment.
Figure 12:
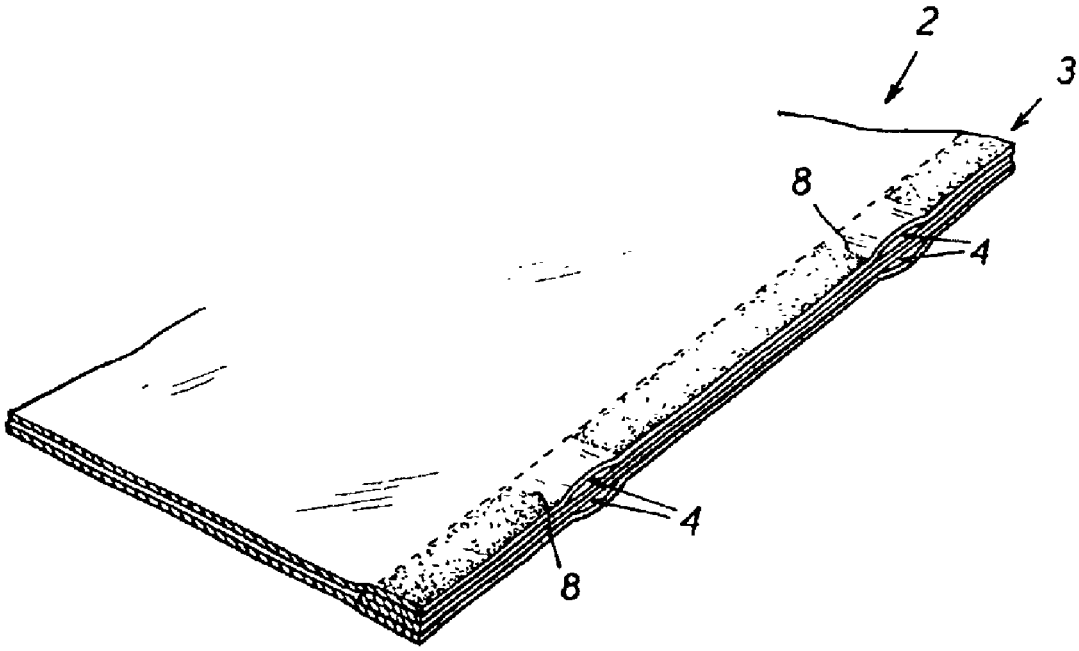
FIG. 12 is an illustration of a perspective view showing the primary part according to the third embodiment.

More specifically, as shown in FIGS. 8 to 10, the fold-back overlap portion 3 folded back in V-shape inside composed of four layer overlap portions 5 is provided in a predetermined position of the bag body 2, the folded-back overlap portion 3 are thermally bonded, overlapped and fixed, non-thermally bonded portions 9 that are not thermally bonded to the folded-back overlap portion 3 are provided, the edge portions of the overlap portions 5 are cutaway to form the degas holes 4 using the non-thermally bonded portions 9 as the degas paths 8.

Accordingly, in accordance with this embodiment, the discharge of the air from the degas holes 4 are further positively performed and of course, there is no problem that the collapse of the loads in reception occurs or the receiving space is reduced. The formation of the degas holes 4 may readily be performed to thereby make it possible to rapidly provide the bag body having a good degas structure.

The other structure is the same as that of the first embodiment.

What is claimed is:

1. A bag body having a degas structure for receiving granules, wherein a fold-back overlap portion that is folded back and kept under and overlap condition is provided at a predetermined position of the bag body, a through-hole is provided in overlap portions forming the fold-back overlap portion, the through-hole is used as a degas hole for discharging air held in an interior of the bag body, the fold-back overlap portion is overlapped and fixed, the fold-back overlap portion has non-thermally bonded portions which are provided as degas paths in communication with the degas hole, and thermally bonded portions are provided adjacent to the fold-back overlap portion, forming two-layer thermally bonded portions each having a strip shape in a length direction of the fold-back overlap portion.

2. A bag body having a degas structure according to claim 1, further characterized in that a fold-back overlap portion that is folded back and kept under an overlap condition is provided at a predetermined position of the bag body, a through-hole is provided in an overlap portion not exposed outside out of the overlap portions forming the fold-back overlap portion so that the through-hole is covered by other overlap portions, and the through-hole is used as a degas hole for discharging air held in an interior of the bag body.

3. A bag body having a degas structure according to claim 1 or 2, further characterized in that the fold-back overlap portion fold back at a predetermined position of the bag body as the fold-back overlap portion and composed of at least three overlap portions is provided and the degas hole is formed in the overlap portions forming the fold-back overlap portion.

4. A bag body having a degas structure according to claim 1 or 2, further characterized in that the fold-back overlap portion is provided in an edge portion of the bag body.

5. A bag body having a degas structure according to claim 3, further characterized in that the fold-back overlap portion is provided in an edge portion of the bag body.

6. A bag body having a degas structure for receiving granules such as grains or manure, wherein a fold-back overlap portion that is folded back in V-shape on the inside and composed of four layers of overlap portions are provided in a predetermined position of a bag body, a through-hole is provided in at least one of the overlap portions of the inside two layers out of the overlap portions forming the folded back overlap portion, the through-hole is provided as a degas hole for discharging air, the fold-back overlap portion is thermally bonded, overlapped and fixed, non-thermally bonded portions that are not thermally bonded are provided in the folded-back overlap portion, wherein the non-thermally bonded portions are provided as degas paths in communication with the degas hole; and an additional thermally bonded portion is provided adjacent to the thermal bonded portion of the folded-back overlap portion, forming a two-layer thermally bonded portion in a strip shape in a length direction of the fold-back overlap portion.

7. A method for producing a bag body having a degas structure for receiving granules, comprising:

providing a fold-back overlap portion that is folded back and kept in an overlap condition at a predetermined position of the bag body, and providing a through-hole in overlap portions forming the fold-back overlap portion, wherein the through-hole is used as a degas hole for discharging air held in an interior of the bag body, wherein the fold-back overlap portion is overlapped and fixed, the fold-back overlap portion has non-thermally bonded portions which are provided as degas paths in communication with the degas hole, and thermally bonding a vicinity position of the fold-back overlap portion, which is a predetermined position of the bag body, into a two-layer thermally bonded portion in a strip shape in a length direction of the fold-back overlap portion.

* * * * *